US011566490B2

(12) United States Patent
Ross

(10) Patent No.: US 11,566,490 B2
(45) Date of Patent: Jan. 31, 2023

(54) GRAVEL PACK SERVICE TOOL USED TO SET A PACKER

(71) Applicant: Halliburton Energy Services, Inc., Houston, TX (US)

(72) Inventor: Colby Munro Ross, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 559 days.

(21) Appl. No.: 14/890,735

(22) PCT Filed: Jan. 22, 2014

(86) PCT No.: PCT/US2014/012439

§ 371 (c)(1),
(2) Date: Nov. 12, 2015

(87) PCT Pub. No.: WO2015/073056

PCT Pub. Date: May 21, 2015

(65) Prior Publication Data

US 2016/0102525 A1 Apr. 14, 2016

Related U.S. Application Data

(60) Provisional application No. 61/903,789, filed on Nov. 13, 2013.

(51) Int. Cl.
*E21B 34/10* (2006.01)
*E21B 23/06* (2006.01)
(Continued)

(52) U.S. Cl.
CPC ..... *E21B 34/10* (2013.01); *E21B 23/06* (2013.01); *E21B 33/126* (2013.01); *E21B 43/04* (2013.01);
(Continued)

(58) Field of Classification Search
CPC ..... E21B 34/10; E21B 23/06; E21B 33/126; E21B 43/04; E21B 43/045; E21B 47/06; E21B 2034/007
See application file for complete search history.

(56) References Cited

U.S. PATENT DOCUMENTS 3,414,059 A * 12/1968 Nutter ..... E21B 23/006 166/150
3,850,242 A * 11/1974 Crowe ..... E21B 34/10 166/324

(Continued)

FOREIGN PATENT DOCUMENTS

WO 2015073056 A1 5/2015

OTHER PUBLICATIONS

International Search Report & Written Opinion in PCT/US2014/012439 dated Aug. 13, 2014.

*Primary Examiner* — Robert E Fuller
*Assistant Examiner* — Neel Girish Patel
(74) *Attorney, Agent, or Firm* — McGuireWoods LLP

(57) ABSTRACT

Disclosed is a gravel pack service tool that utilizes an internal closure device to set a packer. One disclosed system includes a completion string including at least one packer, a service tool configured to be arranged within the completion string and having an interior that provides a flow path for fluids and a crossover tool, and a closure device arranged within the flow path and being actuatable between an open position and a closed position in response to a signature pressure pulse detected by the closure device, wherein, when the closure device is in the open position, the fluids are able to bypass the closure device and flow to lower portions of the service tool, and wherein, when the closure device is in the closed position, the fluids are prevented from bypassing
(Continued)

the closure device and a pressure within the service tool is increased to set the at least one packer.

17 Claims, 6 Drawing Sheets

(51) Int. Cl.
*E21B 43/04* (2006.01)
*E21B 33/126* (2006.01)
*E21B 47/06* (2012.01)

(52) U.S. Cl.
CPC ..... *E21B 43/045* (2013.01); *E21B 47/06* (2013.01); *E21B 2200/06* (2020.05)

(56) References Cited

U.S. PATENT DOCUMENTS 3,912,008 A * 10/1975 Crowe ..... E21B 34/14 166/212
5,343,963 A * 9/1994 Bouldin ..... E21B 47/18 175/27
6,253,861 B1 * 7/2001 Carmichael ..... E21B 21/103 175/237
7,377,690 B1 * 5/2008 Diede ..... F42B 39/14 102/364
8,201,804 B2 * 6/2012 Strazhgorodskiy ..... E21B 21/00 251/183
8,752,486 B2 * 6/2014 Robertson ..... E21B 23/04 102/531
2002/0020535 A1 * 2/2002 Johnson ..... E21B 49/08 166/363
2003/0205688 A1 * 11/2003 Milberger ..... F16K 31/52425 251/315.01
2003/0230405 A1 * 12/2003 Allamon ..... E21B 33/16 166/193
2005/0178552 A1 * 8/2005 Fehr ..... E21B 34/12 166/305.1
2007/0272410 A1 * 11/2007 Hromas ..... E21B 34/10 166/298
2008/0128130 A1 * 6/2008 Whitsitt ..... E21B 23/04 166/278
2009/0025923 A1 * 1/2009 Patel ..... E21B 43/045 166/51
2009/0056952 A1 * 3/2009 Churchill ..... E21B 34/14 166/373
2009/0071658 A1 * 3/2009 Reid ..... E21B 43/12 166/373
2009/0145603 A1 * 6/2009 Coronado ..... E21B 43/045 166/255.1
2010/0012318 A1 * 1/2010 Luce ..... E21B 43/04 166/278
2010/0122814 A1 * 5/2010 Picou ..... E21B 27/02 166/278
2010/0163235 A1 * 7/2010 Mootoo ..... E21B 43/045 166/278
2010/0269914 A1 * 10/2010 Graham ..... B09C 1/00 137/236.1
2011/0067862 A1 * 3/2011 Clem ..... E21B 43/045 166/278
2011/0203670 A1 * 8/2011 Braddick ..... F16K 5/0626 137/1
2012/0061095 A1 * 3/2012 Capderou ..... E21B 47/18 166/373
2013/0061899 A1 * 3/2013 Tosi ..... E21B 41/0085 136/202
2014/0034336 A1 * 2/2014 Jasek ..... E21B 43/04 166/387
2015/0330186 A1 * 11/2015 Budde ..... E21B 34/12 166/373
2016/0084040 A1 * 3/2016 Brasseaux ..... E21B 34/14 166/374

* cited by examiner

GRAVEL PACK SERVICE TOOL USED TO SET A PACKER

CROSS-REFERENCE TO RELATED APPLICATIONS

The present application claims priority to U.S. Provisional Patent App. Ser. No. 61/903,789, filed on Nov. 13, 2013.

BACKGROUND

The present disclosure is related to wellbore completion operations and, more particularly, to a gravel pack service tool that utilizes an internal closure device to set a packer.

In the oil and gas industry, particulate materials such as sand and other wellbore debris are often produced to the surface during the extraction of hydrocarbons from a well traversing unconsolidated or loosely consolidated subterranean formations. Producing such particulate matter can cause abrasive wear to components within the well, such as tubing, pumps, and valves, and can sometimes partially or fully clog the well creating the need for an expensive workover operation. In addition, if the particulate matter is produced to the surface, it must be removed from the extracted hydrocarbons by various processing equipment at the surface.

In order to prevent the production of such particulate material to the surface, unconsolidated or loosely consolidated production intervals in the well are often gravel packed. In a typical gravel pack completion, a completion string including a top packer, a circulation valve, a fluid loss control device and one or more sand control screens, is lowered into the wellbore on a service tool to a position proximate the desired production interval. The service tool is then positioned within the completion string and a fluid slurry that includes a liquid carrier and a particulate material (i.e., gravel) is then pumped through the circulation valve and into the well annulus formed between the sand control screens and the perforated well casing or open hole production zone. The liquid carrier either flows into the adjacent formation or returns to the surface by flowing through the sand control screens, or both. In either case, the gravel is deposited around the sand control screens to form a gravel pack, which is highly permeable to the flow of hydrocarbon fluids but simultaneously blocks the flow of the particulate material often carried in the hydrocarbon fluids. As such, gravel packs can successfully prevent the problems associated with the production of particulate materials from the formation.

Before gravel packing operations can begin, however, the completion string must be secured within the wellbore by setting the top packer. To accomplish this, a wellbore projectile, such as a ball, is usually introduced into the wellbore and pumped to the service tool until landing on a ball seat adjacent a setting tool associated with the service tool. Once the ball sealingly engages the ball seat, the service tool can then be pressurized from the surface to force the ball to open a sleeve that enables the pressurized fluid to set the top packer and secure the completion string within the wellbore.

In some wellbores, however, the ball has difficulty reaching the ball seat. For instance, some wellbores have sections that are deviated, sections that run uphill, and/or sections that are u-shaped. In such wellbore sections or areas, a large amount of fluid circulation is required to keep the ball moving within the wellbore in order to pump the ball to the ball seat. Moreover, when the ball eventually arrives at the ball seat, it is sometimes damaged and therefore unable to generate a seal on the ball seat. In other cases, debris is pumped along with the ball toward the ball seat and subsequently obstructs the sealing engagement between the ball and the ball seat.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to wellbore completion operations and, more particularly, to a gravel pack service tool that utilizes an internal closure device to set a packer.

Disclosed are systems and methods of setting a packer in a gravel pack completion string using an electromechanical closure device arranged within and otherwise associated with a gravel pack service tool. The method involves providing pressure pulses to an interior flow path of the service tool that are sensed by the closure device that may be arranged in various locations within the interior of the service tool along the flow path. Upon sensing a pressure pulse signature, the closure device is activated to a closed position and thereby provides a fluid barrier or seal in the service tool that allows the service tool to be pressurized from the surface to set a packer associated with the completion string. The closure device can be arranged at several locations within the service tool. One location would be at the end of the wash pipe. Another location would be immediately below a three-way crossover associated with the service tool. A third location could be below the crossover of the service tool.

Figure 1:
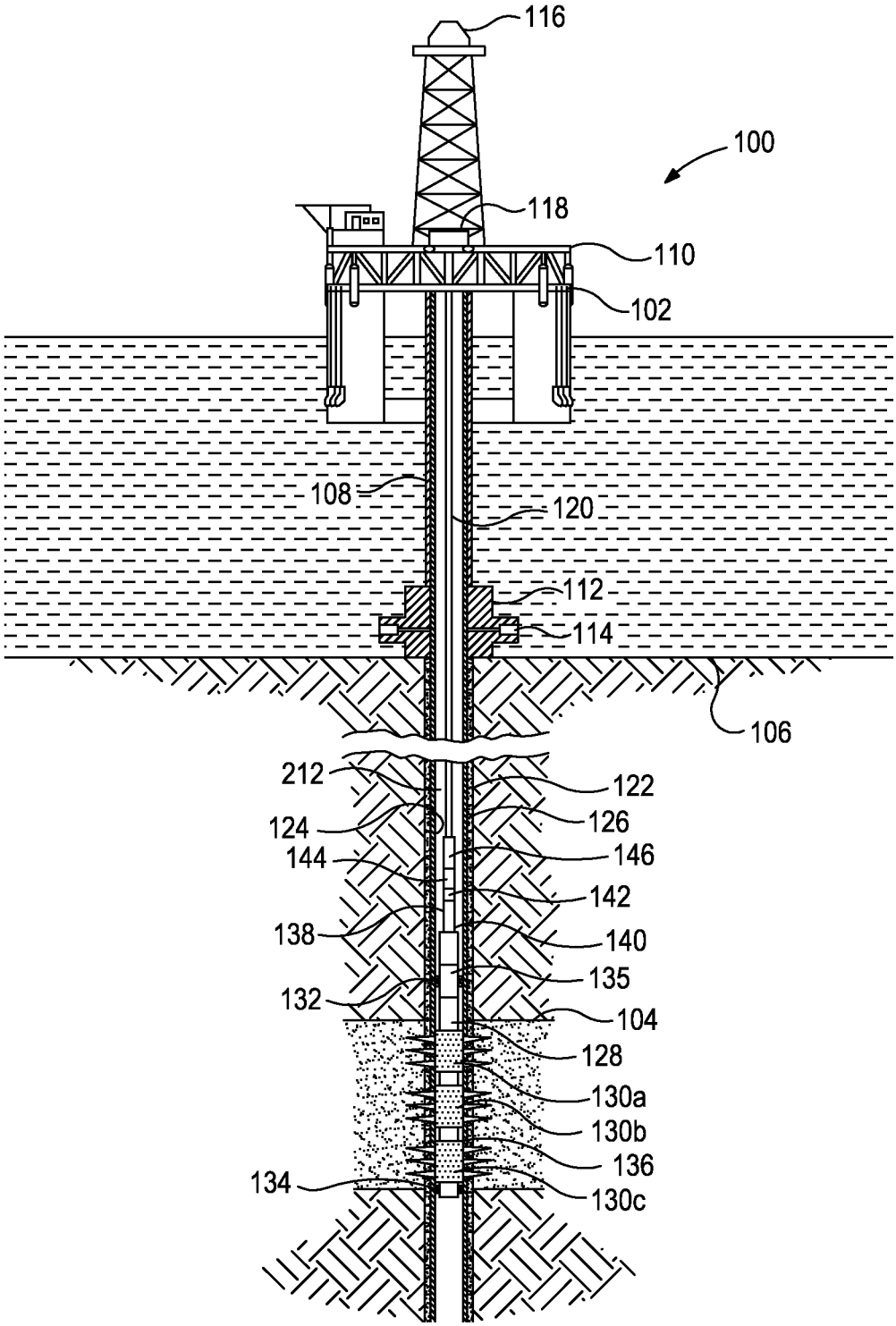
FIG. 1 illustrates an exemplary well system that employs one or more principles of the present disclosure, according to one or more embodiments.

Referring FIG. 1, illustrated is an exemplary well system 100 that may employ one or more principles of the present disclosure, according to one or more embodiments. As illustrated, the well system 100 may include an offshore oil and gas platform 102 located above a submerged hydrocarbon-bearing formation 104 located below the sea floor 106. A subsea conduit or riser 108 extends from a deck 110 of the platform 102 to a wellhead installation 112 that may include one or more blowout preventers 114. The platform 102 may include a derrick 116 and a hoisting apparatus 118 for raising and lowering pipe strings, such as a work string 120. While the system 100 depicts the use of the offshore platform 102, it will be appreciated that the principles of the present disclosure are equally applicable to other types of oil and gas rigs, such as land-based drilling and production rigs, service rigs, and other oil and gas rigs located at any geographical location.

A wellbore 122 extends from the wellhead installation 112 and through various earth strata, including the formation 104. Casing 124 may be cemented within at least a portion of the wellbore 122 using cement 126. A completion string 128 is depicted in FIG. 1 as being installed within the casing 124 and may include one or more sand control devices, such as sand screens 130*a*, 130*b*, and 130*c* positioned adjacent the formation 104 between packers 132 and 134. In some embodiments, the upper packer 132 may be part of a circulating valve 135.

When it is desired to gravel pack the annulus 136 defined about the sand control screens 130*a-c*, the work string 120 may be lowered through the casing 124 and at least partially into the completion string 128. The work string 120 may include a service tool 138 having a wash pipe 140, a reverse-out valve 142, a crossover tool 144, a setting tool 146, and other downhole tools known to those skilled in the art. Once the service tool 138 and completion string are properly positioned within the casing 124, the setting tool 146 may be hydraulically operated in order to set the upper packer 132 and thereby secure the completion string 128 within the wellbore 122. As will be described in more detail below, the setting tool 146 may be operated by actuating a closure device (not shown) arrangeable within the interior of the service tool 138 at various locations. Once the upper packer 132 is properly set, the service tool 138 may be operated to undertake several wellbore operations including, but not limited to, gravel packing operations, frack packing operations, injecting well stimulation treatments, circulating fluids in the well, reversing out, and squeezing fluids.

Even though FIG. 1 depicts a vertical well, it will be appreciated by those skilled in the art that the principles of the present disclosure are equally well-suited for use in deviated wells, inclined wells, horizontal wells, or multilateral wellbore completions. Also, even though FIG. 1 depicts a cased wellbore 122, those skilled in the art will readily appreciate that the principles of the present disclosure are equally well-suited for use in open-hole completions. Additionally, even though FIG. 1 has been described with reference to a gravel packing operation, it should be noted by one skilled in the art that the principles of the present disclosure are equally well suited for use in a variety of treatment operations where it is desirable to set a hydraulically-operated packer or wellbore packing element or device.

Figure 2:
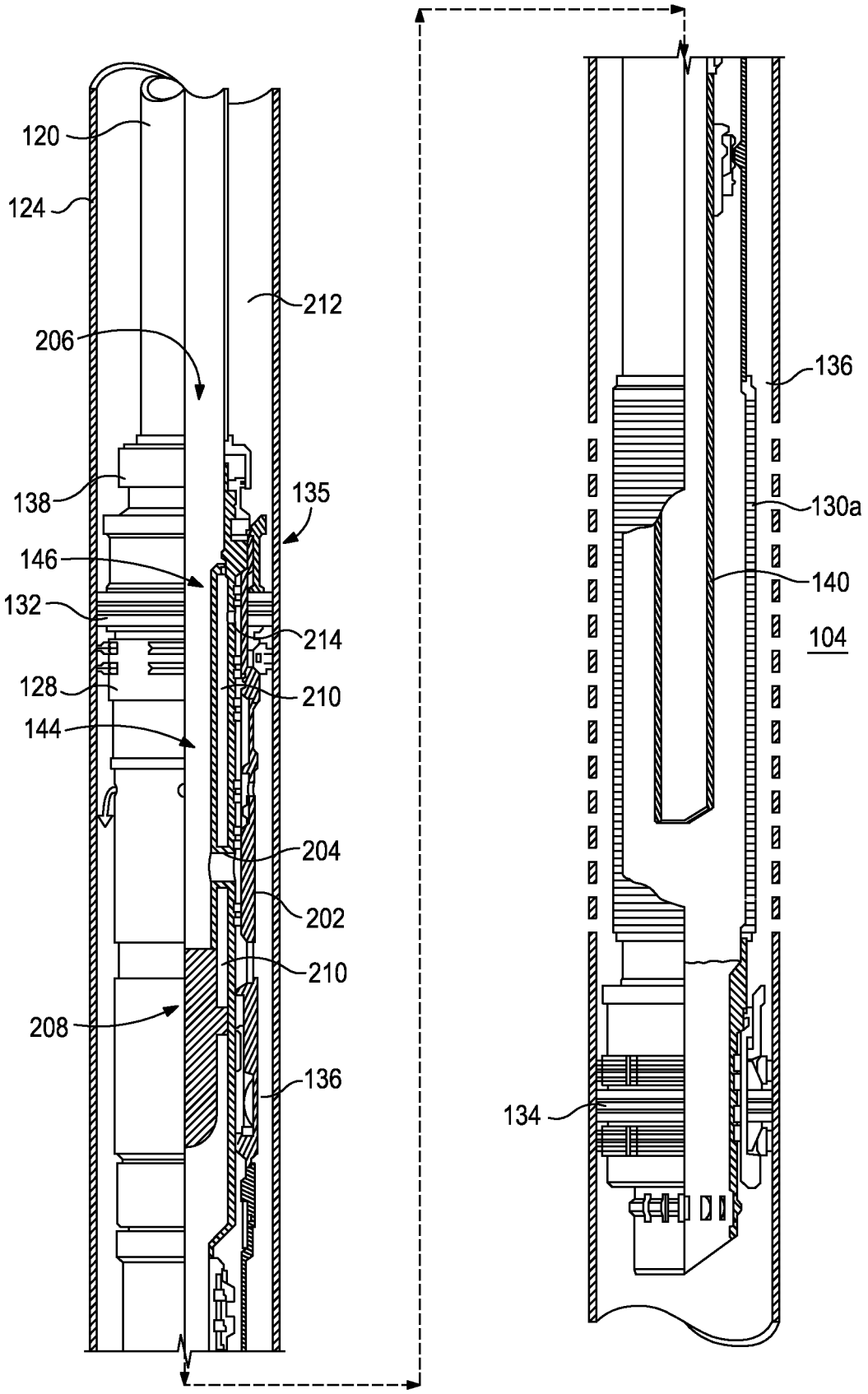
FIG. 2 illustrates a partial cross-sectional side view of the service tool positioned at least partially within the completion string, according to one or more embodiments.

Referring now to FIG. 2, with continued reference to FIG. 1, illustrated is a partial cross-sectional side view of the service tool 138 positioned at least partially within the completion string 128, according to one or more embodiments. More particularly, FIG. 2 depicts the service tool 138 in a run-in configuration as the conveyance 120 delivers the service tool 138 to the location of the completion string 128. It should be noted that only one sand screen 130*a* is depicted in FIG. 2 for illustrative purposes in describing the features of the present disclosure. Those skilled in the art, however, will readily appreciate that more than one sand screen 130 (i.e., each of the sand screens 130*a-c* of FIG. 1 or more) may be used, without departing from the scope of the disclosure. Moreover, it is again noted that while FIG. 2 depicts the completion string 128 as being arranged in a cased portion of the wellbore 108 (FIG. 1), the principles of the present disclosure are equally suited for use in open hole completions where the casing 124 is omitted.

In the run-in configuration, a seal bore 202 occludes and otherwise seals one or more circulation ports 204 associated with the crossover tool 144. As a result, any fluid entering an interior 206 of the service tool 138 is prevented from exiting the service tool 138 and into the annulus 136 via the circulation ports 204. Instead, the fluid may be directed or otherwise conveyed further downhole within the service tool 138 until encountering a closure device 208 that may be arranged at several locations within the flow path defined in the interior 206 of the service tool 138. As used herein, the "flow path" defined in the interior 206 of the service tool 138 may include and otherwise encompass the axial area or volume within the interior 206 of the service tool 138 that extends at least from the crossover tool 144 to the distal end of the wash pipe 140. In the illustrated embodiment, the closure device 208 is depicted as being generally arranged within the flow path adjacent or otherwise directly below the crossover tool 144 and its associated circulation ports 204. As will be discussed below, however, the closure device 208 may equally be arranged at several other locations within the flow path, without departing from the scope of the disclosure.

The closure device 208 may be actuatable between an open position and a closed position. In the open position, fluids flowing within the flow path that encounter the closure device 208 may be able to pass through the closure device 208 and subsequently flow to lower portions of the service tool 138. In the closed position, however, the fluids may be prevented from bypassing the closure device 208, thereby enabling the service tool 138 to be hydraulically-pressurized so that the setting tool 146 may operate to set a packer, such as the top packer 132. When the service tool 138 is in the run-in configuration, and as the service tool 138 is being conveyed to the location of the completion string 128, the closure device 138 is generally in its open position until properly actuated.

Figure 3:
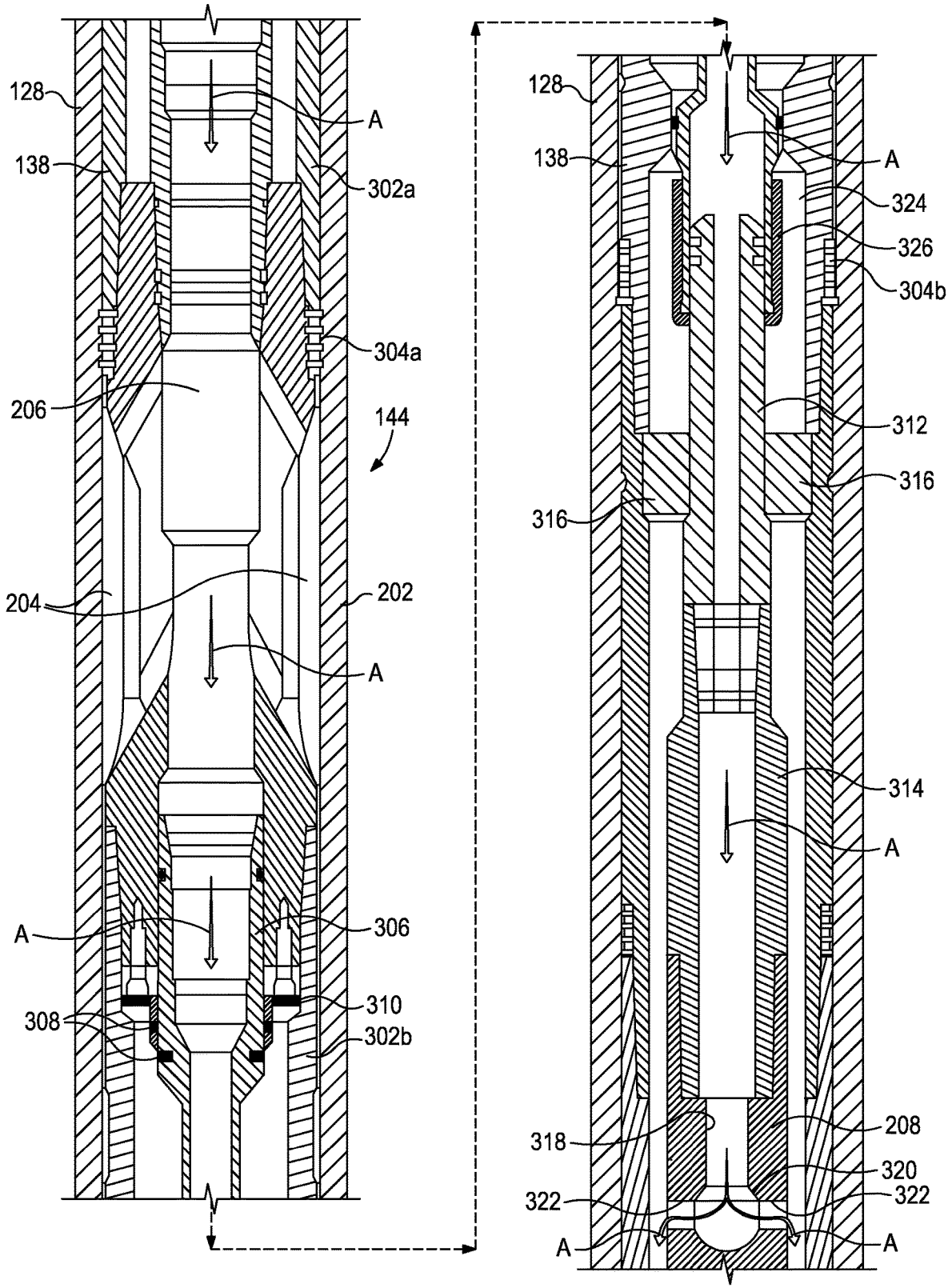
FIG. 3 illustrates a cross-sectional view of a portion of the service tool and the exemplary closure device of FIG. 2, according to one or more embodiments.

Referring now to FIG. 3, with continued reference to FIG. 2, illustrated is a cross-sectional view of a portion of the service tool 138 within a corresponding portion of the completion string 128, according to one or more embodiments. More particularly, FIG. 3 depicts the crossover tool 144 and the closure device 208 being axially offset therefrom within the flow path in the interior 206 of the service tool 138. As illustrated, the service tool 138 is in its run-in configuration where the circulation ports 204 are generally occluded by the seal bore 202. As will be appreciated, in other embodiments, the circulation ports 204 may be occluded by a sliding sleeve or the like (not shown) arranged internal to the circulation ports 204, without departing from the scope of the disclosure. In the run-in configuration, seal mandrels 302*a* and 302*b* including corresponding molded seals 304*a* and 304*b*, respectively, may be arranged on opposing axial ends of the circulation ports 204. The molded seals 304*a,b* may be configured to provide a sealed engagement with the seal bore 202, thereby preventing fluids within the interior 206 of the service tool 138 from escaping through the circulation ports 204.

A circulating sleeve 306 may be arranged within the service tool 138 adjacent or generally below the circulation ports 204. The circulating sleeve 306, also known as a hydroplug, may be axially movable based on hydraulic pressure within the interior 206 of the service tool 138. The circulating sleeve 306 may be secured to the service tool 138 using one or more shear pins 308. In the illustrated embodiment, the shear pin 308 is depicted as having been sheared or otherwise broken as the circulating sleeve 306 has been moved axially downward with respect to the service tool 138. Further axial movement of the circulating sleeve 306 in the downward direction will allow a snap ring 310 to radially contract and thereby secure the circulating sleeve 306 in an open configuration. Movement of the circulating sleeve 306, shearing of the shear pin 308, and securing the circulating sleeve 306 with the snap ring 310 are discussed further below.

The closure device 208 may be arranged below the circulating sleeve 306 and operatively coupled thereto using one or more structural elements associated with the service tool 138. For instance, in some embodiments, the service tool 138 may further include a fluted centralizer 312 and an adapter 314 coupled to the distal end of the fluted centralizer 312. The fluted centralizer 312 may include a series of fins 316 (two shown) arranged about the body of the fluted centralizer 312. As illustrated, the fluted centralizer 312 may be coupled to the circulating sleeve 306, the adapter 314 may be coupled to the fluted centralizer 312, and the closure device 208 may be coupled to the adapter 314. The coupled engagements between one or more of the circulating sleeve 306, the fluted centralizer 312, the adapter 314, and the closure device 208 may be threaded engagements. In other embodiments, however, the coupled engagements may use one or more mechanical fasteners, such as bolts, screws, snap rings, etc.

In at least one embodiment, the adapter 314 may be omitted from the service tool 138 and the closure device 208 may instead be directly coupled to the fluted centralizer 312, without departing from the scope of the disclosure. Accordingly, the closure device 208 may be considered to be operatively coupled to the circulating sleeve 306 such that axial movement of the circulating sleeve 306 correspondingly moves the closure device 208, regardless of whether both the fluted centralizer 312 and the adapter 314 are used and otherwise interposing the closure device 208 and the circulating sleeve 306.

As illustrated, the closure device 208 may include an inlet 318, a movable valve member 320, and one or more outlets 322 (two shown). The closure device 208 may be in fluid communication with the interior 206 of the service tool 138 such that fluids flowing within the flow path of the service tool 138 are able to enter the closure device 208 via the inlet 318. The inlet 318 may direct fluids to the movable valve member 320, which may be configured to convey the fluids to the outlets 322. As mentioned above, the closure device 208 may be actuatable between open and closed positions. In the open position, fluids are able to pass through the closure device 208 via the inlet 318 and the outlets 322 and subsequently to lower portions of the service tool 138. In the closed position, however, the outlets 322 may be rotated or otherwise moved to an occluded position where fluids are generally prevented from bypassing the closure device 208.

Figure 4:
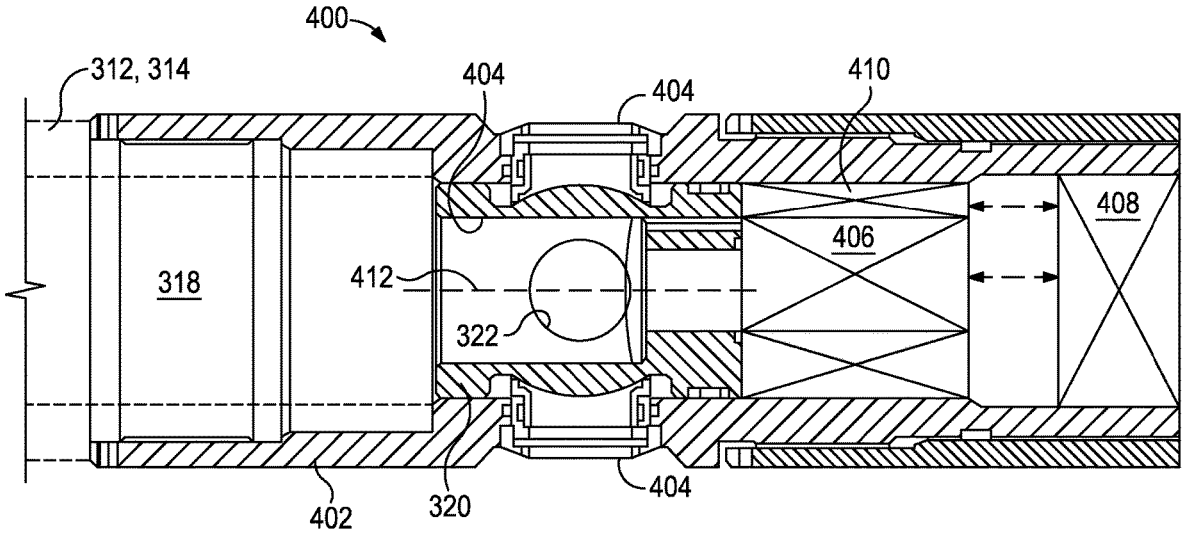
FIG. 4 illustrates an enlarged cross-sectional view of an exemplary closure device, according to one or more embodiments.

Referring to FIG. 4, with continued reference to FIG. 3, illustrated is an enlarged cross-sectional view of an exemplary closure device 400, according to one or more embodiments. The closure device 400 may be the same as or similar to the closure device 208 of FIG. 3 and therefore may be best understood with reference thereto, where like numerals represent like elements not described again in detail. The closure device 400 may be a computer-controlled and pressure-responsive ball valve that may be repeatedly opened and closed by remote command. In at least one embodiment, the closure device 400 may be characterized as an electromechanical ball valve device, which may encompass an electronic remote equalization device or tool commercially available under the trade name ERED® and manufactured by Red Spider Technology through Halliburton Energy Services of Houston, Tex., USA.

As illustrated, the closure device 208 may be coupled to either the adapter 314 or the fluted centralizer 312 (shown in phantom). More specifically, the closure device 208 may have an inner threaded engagement (i.e., box end) configured to mate with an outer threaded engagement (i.e., pin end) of one of the adapter 314 or the fluted centralizer 312. Again, such coupling engagement may alternatively be a mechanically-fastened engagement, without departing from the scope of the disclosure.

The closure device 400 may include a body 402 and the movable valve member 320 may be movably arranged within the body 402. As illustrated, the movable valve member 320 may include or otherwise have defined therein an inlet port 404 in fluid communication with the inlet 318 to the closure device 400. The inlet port 404 may place the outlets 322 (one shown) in fluid communication with the interior 206 (FIGS. 2 and 3) of the service tool 138 (FIGS. 2 and 3) via the inlet 318.

The closure device 400 may further include a sensing system 406, a signal processor 408, and one or more actuation devices 410 (one shown) arranged within the body 402. The inlet port 404 may feed a central flow channel that extends axially through the movable valve member 320 and fluidly communicates with the sensing system 406. The sensing system 406 may include one or more pressure sensors or transducers configured to detect, measure, and report fluid pressures within the closure device 400.

The sensing system 406 may be communicably coupled to the signal processor 408 and configured to receive pressure signals generated by the sensing system 406. While not shown, the signal processor 408 may include various computer hardware used to operate the closure device 400. For example, the computer hardware may include, but is not limited to a processor configured to execute one or more sequences of instructions, programming stances, or code stored on a non-transitory, computer-readable medium. The processor can be, for example, a general purpose microprocessor, a microcontroller, a digital signal processor, an application specific integrated circuit, a field programmable gate array, a programmable logic device, a controller, a state machine, a gated logic, discrete hardware components, an artificial neural network, or any like suitable entity that can perform calculations or other manipulations of data. In some embodiments, computer hardware can further include elements such as, for example, a memory (e.g., random access memory (RAM), flash memory, read only memory (ROM), programmable read only memory (PROM), erasable read only memory (EPROM)), registers, hard disks, removable disks, CD-ROMS, or any other like suitable storage device or medium.

The actuation device 410 may be communicably coupled to the signal processor 408 and configured to actuate the movable valve member 320 upon receiving a command signal generated by the signal processor 408. The actuation device 410 may be any electrical, mechanical, electromechanical, hydraulic, or pneumatic actuation device that is able to move the movable valve member 320 between open and closed positions. In the illustrated embodiment, for example, when a command signal is received from the signal processor 408, the actuation device 410 may be configured to rotate the movable valve member 320 about a central axis 412. The movable valve member 320 is depicted in FIG. 4 in a closed position, where the outlets 322 are misaligned with one or more corresponding radial outlet ports 404 defined in the body 402. When placed in the open position, however, the outlets 322 are rotated 90° and otherwise aligned with the radial outlet ports 404 defined in the body 402. When aligned with the radial outlet ports 404, the outlets 322 are able to radially eject fluids from the closure device 400 into the surrounding environment, thereby allowing fluids to pass through the closure device 400 and flow further downhole.

In operation, the closure device 400 may be programmed to be responsive to pressure pulses introduced into the interior 206 of the service tool 138 (FIGS. 2 and 3) from a surface location. The sensing system 406, for instance, may be configured to detect the pressure pulses received from the interior 206 of the service tool 138 and report the same to the signal processor 408. The signal processor 408 may then be configured to process the received pressure signals and compare the pressure pulses with one or more signature pressure pulses stored in its memory. Once a predetermined or signature pressure pulse or cycle of pulses is detected by the sensing system 406 and processed by the signal processor 408, the signal processor 408 may be configured to generate and send a command signal to the actuation device 410 to actuate the closure device 400 between open and closed positions.

The signature pressure pulse(s) that may trigger the closure device 400 may include one or more cycles of pressure pulses at a predetermined amplitude (i.e., strength or pressure) and/or over a predetermined amount of time (i.e., frequency). One exemplary signature pressure pulse that may actuate the closure device 400 may include: a) pressurizing the service tool 138 for a predetermined amount of time (e.g., 2 minutes) at a predetermined pressure, b) bleeding off the pressure, c) pressurizing the service tool 138 again for the predetermined amount of time (e.g., 2 minutes) at the predetermined pressure, and c) again bleeding off the pressure. This cycle may be repeated a predetermined number of times to match a particular signature stored in the memory of the signal processor 408. In other embodiments, the signature pressure pulse may be a series of pressure increases over a predetermined or defined time period followed by a reduction of the pressure for another predetermined or defined period. As will be appreciated by those skilled in the art, there are several different types or configurations of potential signature pressure pulses that may be used to trigger actuation of the closure device 400. The example given above is merely illustrative of one signature pressure pulse and should not be considering limiting to the scope of the present disclosure.

Upon detecting and processing the predetermined signature pressure pulse(s), the command signal may then be sent to the actuation device 410 in order to actuate the movable valve member 320. In some embodiments, the signal processor 408 may include a timer or timing mechanism configured to delay transmission of the command signal for a predetermined time period, and thereby delay the actuation of the movable valve member 320. As will be appreciated, predetermined signature pressure pulses or cycles may be configured to open and/or close the closure device 400 multiple times. In other embodiments, the closure device 400 may be programmed to receive a particular signature pressure pulse that results in the closure device 400 remaining in the closed position regardless of any subsequent pressure pulses detected by the sensing system 406. Moreover, while not shown, the closure device 400 may further include a power source (e.g. a battery or battery pack) used to power the various components of the closure device 400.

Referring once again to FIG. 3, with additional reference to FIG. 2, exemplary operation of the gravel pack service tool 138 in conjunction with the closure device 208 in order to set the top packer 132 will now be provided. The service tool 138 may be introduced into the completion string 128 and run to bottom. In at least one embodiment, for instance, the completion string 128 may be stung into or otherwise secured to the bottom (sump) packer 134 (FIG. 2). A fluid may then be introduced into the interior 206 of the service tool 138 and flow within the flow path, as indicated by the arrows A. The fluid A may bypass the circulation ports 204 (since they are occluded by the seal bore 202) and proceed within the flow path down through the circulating sleeve 306, the fluted centralizer 312, and the adapter 314. As indicated above, during run-in the closure device 208 may be in the open position. Accordingly, upon encountering the closure device 208, the fluid A may enter the closure device 208 via the inlet 318 and pass therethrough via the movable valve member 320 and the outlets 322 as radially aligned with corresponding radial outlet ports, such as the radial outlet ports 404 of FIG. 4. The fluid A may then proceed further below the closure device 208 within the service tool 138.

When it is desired to close the closure device 208, a predetermined or signature pressure pulse may be conveyed to the closure device 208 through the fluid A from the surface. As discussed above with reference to FIG. 4, once the signature pressure pulse has been accurately detected and reported by the closure device 208, the movable valve member 320 may be actuated to the closed position, where the outlets 322 are misaligned with the corresponding radial outlet ports 404 (FIG. 4), and thereby substantially preventing fluid flow through the closure device 208. With the closure device 208 in the closed position, the pressure of the fluid A within the service tool 138 may then be increased to operate the setting tool 146 (FIG. 2) and thereby set the packer 132 (FIG. 2).

In some embodiments, increasing the pressure of the fluid A within the service tool 138 may also serve to actuate the circulating sleeve 306. With the closure device 208 in its open position or configuration, the fluid A is allowed to equalize pressure across the circulation sleeve 306. Once the closure device 208 begins to close, however, a pressure differential is generated that acts on the circulating sleeve 306 and urges the circulating sleeve 306 to move. More particularly, the increasing fluid pressure may act on the piston area provided by the circulating sleeve 306, and thereby force the circulating sleeve 306 to shear its associated shear pins 308 (or another type of locking mechanism) and move axially downward within the service tool 138. As the circulating sleeve 306 axially translates downward within the service tool 138, the snap ring 310 may be able to radially contract and thereby secure the circulating sleeve 306 in an open or downward position.

Conventional circulating sleeves often include flow ports that would allow the fluid A exit the circulating sleeve 306 into an annulus 324 defined between the circulating sleeve 306 and the inner wall of the service tool 138. In the illustrated embodiment, however, flow ports are either not included in the design of the circulating sleeve 306 or are otherwise occluded with a cap 326 arranged about the outer surface of the circulating sleeve 306. Accordingly, when run in the well the circulating sleeve 306 may be configured to generally block flow up the annulus 324 to ensure that any wash down flow would proceed to the end of the wash pipe 140 and not return to the annulus 324 below the crossover tool 144.

As the circulating sleeve 306 moves to the open configuration, a return flow path (not shown) becomes exposed and provides fluid communication through a return conduit 210 (FIG. 2). As shown in FIG. 2, the return conduit 210 bypasses the circulation ports 204 and fluidly communicates with the annulus 212 defined between the work string 120 and the wellbore 122 (FIG. 1) above the top packer 132 via one or more return ports 214. By allowing an amount of fluid flow into the return conduit 210 above the packer 132, a well operator is able to maintain pressure on the formation 104.

In some embodiments, the circulating sleeve 306 may be configured to move to the open configuration prior to setting the packer 132 (FIG. 2) so as to ensure that the return flow path via the return conduit 210 is open to maintain pressure on the formation 104 before fluid flow around the packer 132 becomes restricted by the packer setting process. The circulating sleeve 306 may therefore operate and otherwise be characterized as a pressure maintenance device that enables pressure to be maintained on the formation 104 while the packer 132 is being set and until the crossover ports 204 are moved to enable circulation to the formation 104. The snap ring 310, or another type of locking mechanism, may be configured to generally lock the circulating sleeve 306 in its open position so as to allow circulation in both directions during circulating and packing operations.

Once the packer 132 is successfully set, the service tool 138 may then be released from the completion string 128 and the well operator may then proceed to undertake various downhole operations using the service tool 138 in conjunction with the completion string 128. Such operations include, but are not limited to, gravel packing operations, hydraulically fracturing the formation 104 (FIG. 2), injecting one or more well stimulation treatments into the formation 104, circulating fluids in the well, reversing out any gravel, proppant, or fluids that may remain within the work string 120, and squeezing fluids. Following the downhole operations, the service tool 138 may be removed from the completion string 128 and returned to the surface for service. In some embodiments, data may be retrieved from the service tool 138 to confirm that the downhole operations occurred as planned. For instance, in at least one embodiment, the pressures recorded by the closure device 208 (i.e., from the signal processor 408 of FIG. 4) may be downloaded or otherwise accessed in order to provide confirmation that the tool operated as expected.

Figure 5:
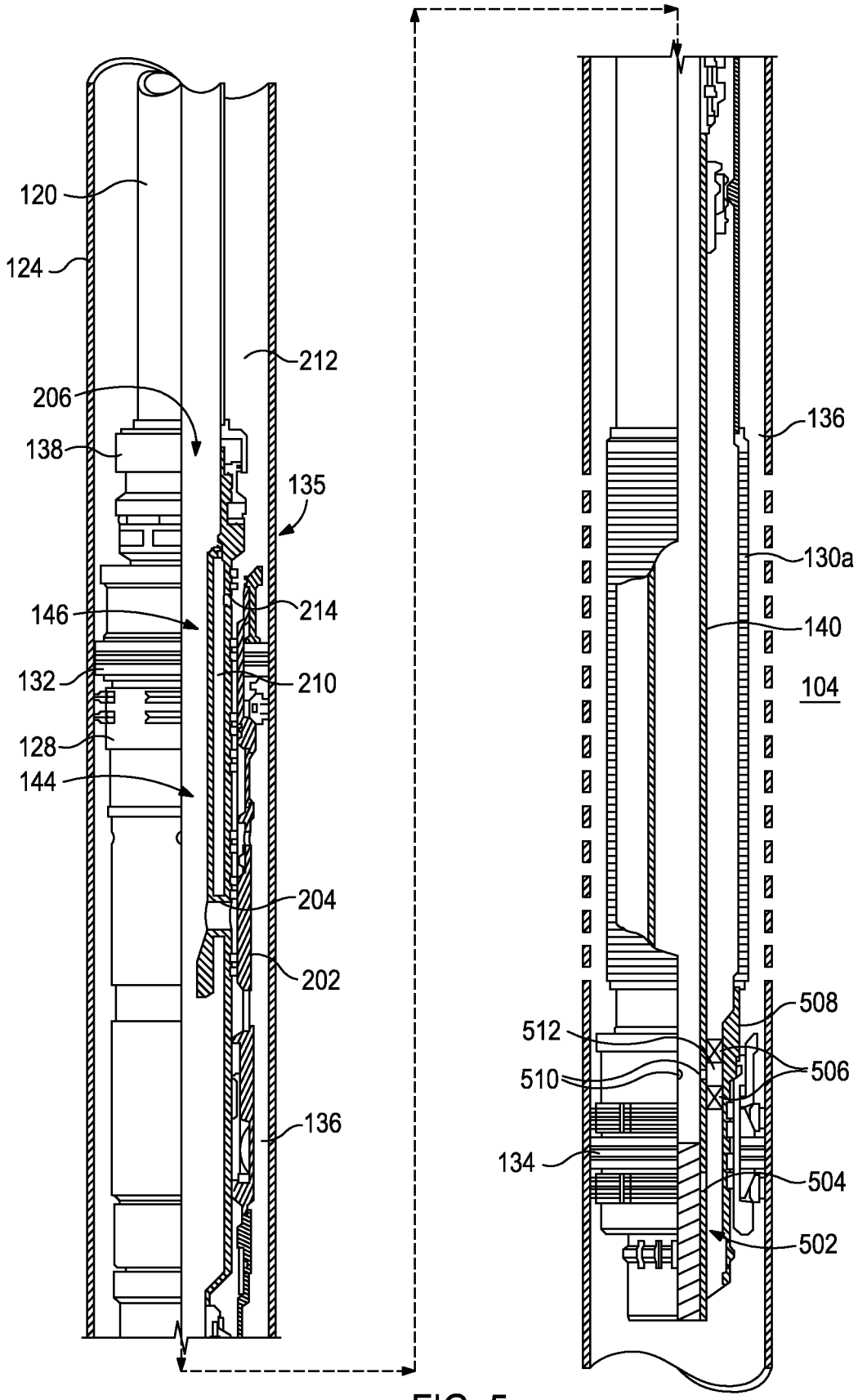
FIG. 5 illustrates a partial cross-sectional side view of the service tool positioned at least partially within the completion string, according to another embodiment of the disclosure.

Referring now to FIG. 5, illustrated is a partial cross-sectional side view of the service tool 138 positioned at least partially within the completion string 128, according to another embodiment of the disclosure. FIG. 5 again depicts the service tool 138 in its run-in configuration where the seal bore 202 occludes the circulation ports 204 associated with the crossover tool 144 and thereby prevents fluids within the interior 206 of the service tool 138 from entering the annulus 136 via the circulation ports 204. Instead, the fluid is directed further downhole within the service tool 138 until encountering a closure device 502 arranged at or near the distal end of the wash pipe 140.

The closure device 502 may be similar in function or the same as one or both of the closure devices 208, 400 described herein. Accordingly, the closure device 502 may be actuatable between an open position and a closed position. In the open position, fluids flowing within the flow path that encounter the closure device 502 may be able to pass therethrough and subsequently flow out of one or more radial outlet ports 504 (one shown) defined therein to lower portions of the service tool 138. In the closed position, however, the fluids may be prevented from bypassing the closure device 502, and thereby enabling the service tool 138 to be hydraulically-pressurized so that the setting tool 146 may operate to set a packer, such as the top packer 132.

In some embodiments, a pair of seals 506 may be arranged above the closure device 502 and interposing the wash pipe 140 and the completion string 128. More particularly, the seals 506 may be configured to form a sealed interface with a seal bore 508 of the completion string 128. The wash pipe 140 may further include or otherwise define one or more flow ports 510 (two shown) arranged axially between the seals 506. The flow ports 510 may be configured to place the interior 206 of the service tool 138 in fluid communication with the annulus 512 defined axially between the seals 506. Once the packer 132 is set and the service tool 138 is moved axially with respect to the completion string 128, the radial outlet ports 504 defined in the closure device 502 would not be required to be opened and would otherwise not present a restriction to flow during subsequent gravel packing operations.

As will be appreciated, the relatively small flow path through the closure device 502 would provide a restriction to circulation of fluids during the gravel packing operation. The flow ports 510 are sealed off between the seals 506 in the run-in position and, once the packer 132 is set and the service tool 138 is moved, the seals 506 are also moved upward, thereby exposing the flow ports 510 ports and providing a larger flow area. With the flow ports 510 exposed, gravel packing operations can proceed as required. For this reason an additional set of holes are provided above the closure device. Accordingly, the flow ports 510 may be configured to enable the use of a closure device 502 that exhibits a relatively small internal flow area and not unduly restrict gravel packing operations.

Figure 6:
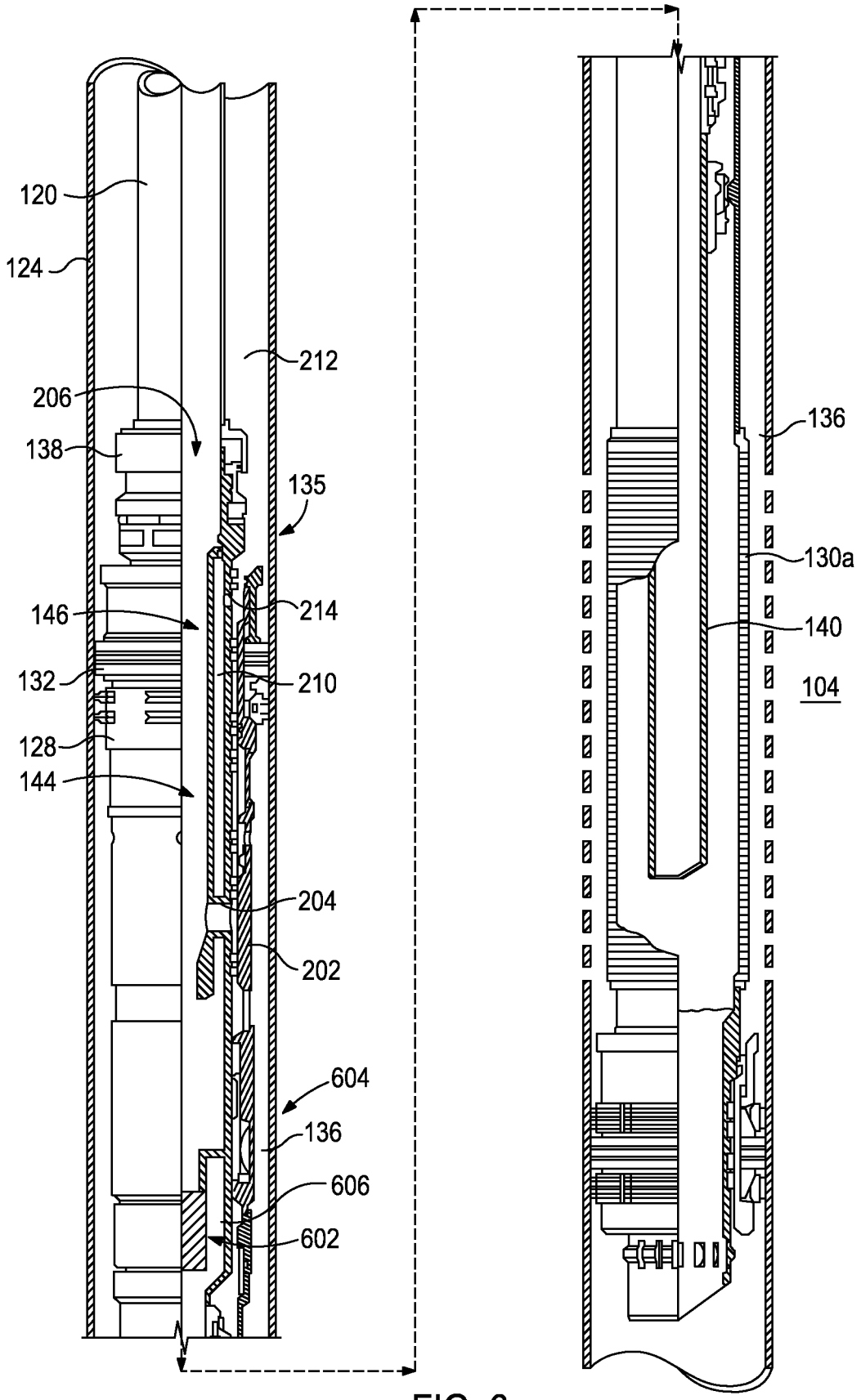
FIG. 6 illustrates a partial cross-sectional side view of the service tool positioned at least partially within the completion string, according to another embodiment of the disclosure.

Referring now to FIG. 6, illustrated is another partial cross-sectional side view of the service tool 138 positioned at least partially within the completion string 128, according to another embodiment of the disclosure. Similar to FIGS. 2 and 5, FIG. 6 depicts the service tool 138 in its run-in configuration where the seal bore 202 occludes the circulation ports 204 associated with the crossover tool 144 and thereby prevents fluids within the interior 206 of the service tool 138 from entering the annulus 136 via the circulation ports 204. Instead, the fluid is directed further downhole within the service tool 138 until encountering a closure device 602 connected to an internal connection of a three-way crossover 604.

As with the closure device 502 of FIG. 5, the closure device 602 may be similar in function or the same as one of the closure devices 208, 400 described herein. Accordingly, the closure device 602 may be actuatable between open and closed positions to regulate fluid flow through the service tool 138. In the open position, fluids flowing within the flow path that encounter the closure device 602 may be able to pass through the closure device 602 and subsequently flow out of one or more radial outlet ports (not shown) defined therein to lower portions of the service tool 138, such as the wash pipe 140. In the closed position, however, the fluids may be prevented from bypassing the closure device 602, thereby enabling the service tool 138 to be hydraulically-pressurized so that the setting tool 146 may operate to set a packer, such as the top packer 132.

The three-way crossover 604 is a tubing adapter that has an upper threaded connection and two lower threaded connections. The upper threaded connection serves to connect the three-way crossover 604 to the body of the service tool 138. The lower threaded connections may be generally radially offset from each other such that an annulus 606 is defined therebetween. The radially outer lower threaded connection may be configured to couple the three-way crossover 604 to lower portions of the service tool 138, including the wash pipe 140, and the radially inner lower threaded connection may be configured to couple the three-way crossover 604 to the closure device 602.

As will be appreciated, using this configuration the closure device 602 can be connected to the lower end of the service tool 120 on the rig floor (i.e., surface location) and closed at that time. This may prove advantageous in minimizing the time that the closure device 602 is required to be in service, which may would be useful in lengthening its battery life. Moreover, this configuration requires no additional seals on the end of the wash pipe 140 and the connections above the closure device 602 can each be tested prior to running the equipment into the well. If the basket is long enough the connection to the closure device 602 could also be made and it could be tested as well. Once the packer 132 is set, the closure device 602 may be re-opened using another signature pressure pulse and left open throughout the remaining downhole operations.

In one or more additional embodiments, the service tool 138 may be introduced into the completion string 128 having one of the closure devices 208, 400, 502, 602 described herein arranged in the flow path in the interior 206 at any of the locations described herein. After the packer 132 (FIGS. 2, 5, and 6) is properly set, as generally described herein, a setting ball (not shown) may be dropped into the wellbore 108 (FIG. 1) and circulated to the service tool 138. The setting ball may be configured to locate and land on the circulating sleeve 306 (FIG. 3), such as a ball seat associated therewith, and thereby seal off the circulating sleeve 306 prior to a gravel packing operation. As will be appreciated, with the closure device 208, 502, 602 in the closed position, and the setting ball landed on the circulating sleeve 306, this would be the reverse position for most conventional gravel pack service tool systems. Moreover, the higher flow rates available through the service tool 138 may be able to provide greater assurance that the setting ball would get to the ball seat and do it more quickly.

Embodiments disclosed herein include:

A. A system that includes a completion string disposable within a wellbore and including at least one packer, a service tool configured to be arranged at least partially within the completion string and having an interior that provides a flow path for fluids, the service tool further including a crossover tool, and a closure device arranged within the flow path and being actuatable between an open position and a closed position in response to a signature pressure pulse detected by the closure device, wherein, when the closure device is in the open position, the fluids are able to bypass the closure device and flow to lower portions of the service tool, and wherein, when the closure device is in the closed position, the fluids are prevented from bypassing the closure device and a pressure within the service tool is increased to set the at least one packer.

B. A method that includes arranging a service tool at least partially within a completion string disposed within a wellbore and having at least one packer, the service tool including a crossover tool and an interior that provides a flow path, flowing a fluid in the flow path and through a closure device arranged within the flow path when the closure device is in an open position, detecting a signature pressure pulse with the closure device, actuating the closure device to a closed position in response to the signature pressure pulse and thereby preventing the fluids from bypassing the closure device, and setting the at least one packer by increasing a fluid pressure within the service tool.

Each of embodiments A and B may have one or more of the following additional elements in any combination: Element 1: wherein the service tool further includes a wash pipe and the flow path extends within the interior of the service tool from at least the crossover tool to a distal end of the wash pipe. Element 2: wherein the closure device comprises a body providing one or more radial outlet ports, a movable valve member arranged within the body, the movable valve member defining one or more outlets, and an inlet defined in the body and fluidly communicating with the movable valve member and the one or more outlets, wherein, when the closure device is in the open position, the one or more outlets are aligned with the one or more radial outlet ports to allow the fluids to flow through the closure device, and wherein, when the closure device is in the closed position, the one or more outlets are misaligned with the one or more radial outlet ports and thereby prevent the fluids from flowing through the closure device. Element 3: wherein the closure device further comprises a sensing system in fluid communication with the flow path via the inlet and the movable valve member, the sensing system including one or more pressure sensors configured to detect and report fluid pressures within the closure device, a signal processor communicably coupled to the sensing system and configured to generate a command signal when the sensing system detects the signature pressure pulse, and an actuation device communicably coupled to the signal processor and configured to receive the command signal and actuate the movable valve member in response thereto, whereby the closure device is moved between the open and closed positions. Element 4: wherein the actuation device is at least one of an electrical actuation device, a mechanical actuation device, an electromechanical actuation device, a hydraulic actuation device, and a pneumatic actuation device. Element 5: wherein the signal processor includes a timer configured to delay transmission of the command signal for a predetermined time period. Element 6: wherein the signature pressure pulse comprises a pressure signature selected from the group consisting of a predetermined number of pressure pulses, a predetermined amplitude of a pressure pulse, a frequency of pressure pulses, or any combination thereof. Element 7: further comprising a circulating sleeve movably arranged within the flow path adjacent to and below the crossover tool, the closure device being operatively coupled to the circulating sleeve below the crossover tool. Element 8: wherein the circulating sleeve is axially movable within the service tool in response to increasing fluid pressure, and wherein, when the circulating sleeve moves downward within the service tool, a return flow path is exposed and provides fluid communication with an annulus defined between the wellbore and the completion string above the at least one packer. Element 9: wherein the service tool includes a wash pipe and the closure device is arranged within the wash pipe at or near a distal end of the wash pipe. Element 10: wherein the service tool includes a three-way crossover and the closure device is arranged within the flow path and connected to an internal connection of the three-way crossover.

Element 11: wherein the closure device comprises a body providing one or more radial outlet ports and having a movable valve member arranged within the body and defining one or more outlets, and wherein flowing the fluid through the closure device comprises aligning the one or more outlets with the one or more radial outlet ports, receiving the fluid in an inlet defined in the body and conveying the fluid to the movable valve member, and ejecting the fluid from the closure device via the one or more outlets and the one or more radial outlet ports. Element 12: wherein detecting the signature pressure pulse with the closure device comprises detecting fluid pressure within the closure device with a sensing system in fluid communication with the flow path, the sensing system including one or more pressure sensors, and reporting the fluid pressure to a signal processor communicably coupled to the sensing system. Element 13: wherein actuating the closure device to the closed position comprises generating a command signal when the sensing system detects the signature pressure pulse, receiving the command signal with an actuation device communicably coupled to the signal processor, and actuating the movable valve member in response to the command signal, wherein, when the closure device is in the closed position, the one or more outlets are misaligned with the one or more radial outlet ports and thereby prevent the fluids from flowing through the closure device. Element 14: further comprising delaying transmission of wherein the command signal for a predetermined time period with a timer included in the signal processor. Element 15: wherein the service tool further includes a circulating sleeve movably arranged within the flow path adjacent to and below the crossover tool, the closure device being operatively coupled to the circulating sleeve below the crossover tool, the method further comprising axially moving the circulating sleeve in response to increasing fluid pressure within the service tool, exposing a return flow path as the circulating sleeve moves downward within the service tool, the return flow path providing fluid communication with an annulus defined between the wellbore and the completion string above the at least one packer, and maintaining fluid pressure on a surrounding formation in the wellbore via the return flow path, and thereby mitigate swabbing effects on the formation. Element 16: wherein axially moving the circulating sleeve comprises shearing one or more shear pins that secure the circulating sleeve to the service tool, axially moving the circulating sleeve downward within the service tool, and locking the circulating sleeve in an open configuration with a locking mechanism. Element 17: further comprising removing the service tool from the completion string and returning the service tool to a surface location, and retrieving data from the service tool to determine if the closure device operated as expected.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

As used herein, a machine-readable medium will refer to any medium that directly or indirectly provides instructions to a processor for execution. A machine-readable medium can take on many forms including, for example, non-volatile media, volatile media, and transmission media. Non-volatile media can include, for example, optical and magnetic disks. Volatile media can include, for example, dynamic memory. Transmission media can include, for example, coaxial cables, wire, fiber optics, and wires that form a bus. Common forms of machine-readable media can include, for example, floppy disks, flexible disks, hard disks, magnetic tapes, other like magnetic media, CD-ROMs, DVDs, other like optical media, punch cards, paper tapes and like physical media with patterned holes, RAM, ROM, PROM, EPROM and flash EPROM.

What is claimed is:

1. A system, comprising:

a completion string disposable within a wellbore and including at least one packer;

a service tool configured to be arranged at least partially within the completion string and having an interior that provides a flow path for fluids, the service tool further including a crossover tool having a circulation port, wherein the service tool further comprises a wash pipe; wherein the service tool further comprises sealing two elements with one of the sealing elements positioned axially on either side of the circulation port; wherein the service tool further comprises a fluted centralizer comprising a series of fins and a body and wherein the fins are arranged about the body;

a closure device arranged to be axially offset from the crossover tool within the interior of the flow path, wherein the closure device comprises a body providing one or more radial outlet ports, wherein the one or more radial outlet ports radially extend through the body of the closure device, the closure device being actuatable between an open position, in which an annulus defined between the completion string and the wellbore is fluidly communicated with the flow path of the service tool via a return conduit, and a closed position in which the closure device occludes the return conduit and blocks the fluid communication between the annulus and the flow path of the service tool, in response to a signature pressure pulse detected by the closure device, wherein the closure device is arranged within the wash pipe at or near a distal end of the wash pipe; wherein the circulation ports are occluded by a sliding sleeve arranged internal to the circulation ports; and a circulating sleeve movably arranged within the flow path adjacent to and below the crossover tool, the closure device being operatively coupled to the circulating sleeve below the crossover tool, wherein axial movement of the circulating sleeve correspondingly moves the closure device, wherein the circulating sleeve does not allow fluid communication into a space between the circulating sleeve and the service tool, wherein the circulation port of the crossover tool is disposed uphole of the circulating sleeve; wherein the circulating sleeve is coupled to the service tool with the fluted centralizer; wherein the circulating sleeve is configured to lock such that fluid circulation occurs in both directions of the circulating sleeve during a circulating and packing operation thereby maintaining pressure on a subterranean formation during said operation; wherein the circulating sleeve is secured to the service tool with a shear pin; wherein axial movement of the circulating sleeve in the downward direction radially contracts a snap ring thereby securing the circulating sleeve in an open configuration;

wherein, when the closure device is in the open position, the fluids are able to bypass the closure device and flow to lower portions of the service tool, and wherein, when the closure device is in the closed position, the fluids are prevented from bypassing the closure device and a pressure within the service tool is increased to set the at least one packer.

2. The system of claim 1, wherein the service tool further includes the wash pipe and the flow path extends within the interior of the service tool from at least the crossover tool to a distal end of the wash pipe.

3. The system of claim 1, wherein the closure device further comprises:

a movable valve member arranged within the body, the movable valve member defining one or more outlets; and an inlet defined in the body and fluidly communicating with the movable valve member and the one or more outlets, wherein, when the closure device is in the open position, the one or more outlets are aligned with the one or more radial outlet ports to allow the fluids to flow through the closure device, and, wherein, when the closure device is in the closed position, the one or more outlets are misaligned with the one or more radial outlet ports and thereby prevent the fluids from flowing through the closure device.

4. The system of claim 3, wherein the closure device further comprises:

a sensing system in fluid communication with the flow path via the inlet and the movable valve member, the sensing system including one or more pressure sensors configured to detect and report fluid pressures within the closure device;

a signal processor communicably coupled to the sensing system and configured to generate a command signal when the sensing system detects the signature pressure pulse; and an actuation device communicably coupled to the signal processor and configured to receive the command signal and actuate the movable valve member in response thereto, whereby the closure device is moved between the open and closed positions.

5. The system of claim 4, wherein the actuation device is at least one of an electrical actuation device, a mechanical actuation device, an electromechanical actuation device, a hydraulic actuation device, and a pneumatic actuation device.

6. The system of claim 4, wherein the signal processor includes a timer configured to delay transmission of the command signal for a predetermined time period.

7. The system of claim 1, wherein the signature pressure pulse comprises a pressure signature selected from the group consisting of a predetermined number of pressure pulses, a predetermined amplitude of a pressure pulse, a frequency of pressure pulses, or any combination thereof.

8. The system of claim 1, wherein the circulating sleeve is axially movable within the service tool in response to increasing fluid pressure, and wherein, when the circulating sleeve moves downward within the service tool, a return flow path is exposed and provides fluid communication with the annulus defined between the wellbore and the completion string above the at least one packer.

9. The system of claim 1, wherein the service tool includes a three-way crossover and the closure device is arranged within the flow path and connected to an internal connection of the three-way crossover.

10. A method, comprising:

arranging a service tool at least partially within a completion string disposed within a wellbore and having an interior that provides a flow path for fluids and also having at least one packer, the service tool including a crossover tool having a circulation port, a circulating sleeve movably arranged within the flow path adjacent to and below the crossover tool; wherein the service tool further comprises sealing two elements with one of the sealing elements positioned axially on either side of the circulation port; wherein the circulating sleeve does not allow fluid communication into a space between the circulating sleeve and the service tool, wherein the circulation port of the crossover tool is disposed uphole of the circulating sleeve; wherein the service tool further comprises a fluted centralizer comprising a series of fins and a body and wherein the fins are arranged about the body; wherein the circulating sleeve is coupled to the service tool with the fluted centralizer; wherein the circulating sleeve is configured to lock such that fluid circulation occurs in both directions of the circulating sleeve during a circulating and packing operation thereby maintaining pressure on a subterranean formation during said operation;

flowing a fluid in the flow path and through a closure device arranged to be axially offset from the crossover tool within the interior of the flow path when the closure device is in an open position, in which an annulus defined between the completion string and the wellbore is fluidly communicated with the flow path of the service tool via a return conduit, the closure device being operatively coupled to the circulating sleeve below the crossover tool, wherein axial movement of the circulating sleeve correspondingly moves the closure device, wherein the closure device comprises a body providing one or more radial outlet ports and having a movable valve member arranged within the body and defining one or more outlets, wherein the one or more radial outlet ports extend radially through the body of the closure device; wherein the circulation ports are occluded by a sliding sleeve arranged internal to the circulation ports;

axially moving the circulating sleeve downward in response to increasing fluid pressure within the service tool; wherein the circulating sleeve is secured to the service tool with a shear pin; wherein axial movement of the circulating sleeve in the downward direction radially contracts a snap ring thereby securing the circulating sleeve in an open configuration;

detecting a signature pressure pulse with the closure device;

actuating the closure device to a closed position in which the closure occludes the return conduit and blocks the fluid communication between the annulus and the flow path of the service tool, in response to the signature pressure pulse and thereby preventing the fluids from bypassing the closure device; and setting the at least one packer by increasing a fluid pressure within the service tool.

11. The method of claim 10, wherein flowing the fluid through the closure device comprises:

aligning the one or more outlets with the one or more radial outlet ports;

receiving the fluid in an inlet defined in the body and conveying the fluid to the movable valve member; and ejecting the fluid from the closure device via the one or more outlets and the one or more radial outlet ports.

12. The method of claim 11, wherein detecting the signature pressure pulse with the closure device comprises:

detecting fluid pressure within the closure device with a sensing system in fluid communication with the flow path, the sensing system including one or more pressure sensors; and reporting the fluid pressure to a signal processor communicably coupled to the sensing system.

13. The method of claim 12, wherein actuating the closure device to the closed position comprises:

generating a command signal when the sensing system detects the signature pressure pulse;

receiving the command signal with an actuation device communicably coupled to the signal processor; and actuating the movable valve member in response to the command signal, wherein, when the closure device is in the closed position, the one or more outlets are misaligned with the one or more radial outlet ports and thereby prevent the fluids from flowing through the closure device.

14. The method of claim 13, further comprising delaying transmission of wherein the command signal for a predetermined time period with a timer included in the signal processor.

15. The method of claim 10, further comprising:

exposing a return flow path as the circulating sleeve moves downward within the service tool, the return flow path providing fluid communication with the annulus defined between the wellbore and the completion string above the at least one packer; and maintaining fluid pressure on a surrounding formation in the wellbore via the return flow path, and thereby mitigate swabbing effects on the formation.

16. The method of claim 15, wherein axially moving the circulating sleeve comprises:

shearing one or more shear pins that secure the circulating sleeve to the service tool;

axially moving the circulating sleeve downward within the service tool; and locking the circulating sleeve in an open configuration.

17. The method of claim 10, further comprising:

removing the service tool from the completion string and returning the service tool to a surface location; and retrieving data from the service tool to determine if the closure device operated as expected.

* * * * *